US005159732A

United States Patent [19]

Burke

[11] Patent Number: 5,159,732

[45] Date of Patent: Nov. 3, 1992

[54] SEAT BELT BUCKLE

[75] Inventor: David Burke, Carlisle, Great Britain

[73] Assignee: BSRD Limited, Carlisle, Great Britain

[21] Appl. No.: 734,067

[22] Filed: Jul. 22, 1991

Related U.S. Application Data

[63] Continuation of Ser. No. 484,140, Feb. 23, 1990, abandoned.

[30] Foreign Application Priority Data

Feb. 23, 1989 [GB] United Kingdom ..... 8904205

[51] Int. Cl.[5] ..... A44B 11/26

[52] U.S. Cl. ..... 24/641; 24/645

[58] Field of Search ..... 24/633, 636–638, 24/641, 645; 297/468

[56] References Cited

U.S. PATENT DOCUMENTS

| | | | |
|---|---|---|---|
| 4,451,958 | 6/1984 | Robben et al. | 24/641 X |
| 4,454,634 | 6/1984 | Haglund et al. | 24/645 X |
| 4,703,542 | 3/1987 | Hirata et al. . | |

FOREIGN PATENT DOCUMENTS

| | | | |
|---|---|---|---|
| 0071013 | 6/1983 | European Pat. Off. . | |
| 98726 | 1/1984 | European Pat. Off. | 24/633 |
| 131255 | 1/1985 | European Pat. Off. | 24/633 |
| 3535056 | 2/1987 | Fed. Rep. of Germany | 24/633 |
| 1351339 | 12/1963 | France | 24/637 |
| WO83/03741 | 11/1983 | PCT Int'l Appl. | 24/633 |
| 8700736 | 12/1987 | PCT Int'l Appl. . | |
| 2151691 | 7/1985 | United Kingdom . | |
| 2166187 | 8/1986 | United Kingdom . | |

*Primary Examiner*—James R. Brittain

[57] ABSTRACT

In a seat belt buckle a U-shaped main frame (1) has two side portions (7,8) and a tilting locking element (15) located between them to be engageable with a belt tongue (4) when inserted therein, a retaining member (27) being movable in L-shaped cut-outs (11,12) in the side portions between locking and unlocking positions in relation to the locking element (15) by action of the tongue or a release button respectively, and inertial rocking member (20) being pivotally carried by the locking element (15) and spring urged towards a position which locks the retaining member into its said locking position and is unresponsive to pretensioning action on the buckle.

17 Claims, 6 Drawing Sheets

SEAT BELT BUCKLE

This application is a continuation of application Ser. No. 07/484,140 filed Feb. 23, 1990, now abandoned.

BACKGROUND AND SUMMARY OF THE INVENTION

This invention relates to a seat belt buckle with a tilting latch.

In the Specification of U.S. Pat. No. 4,451,958 there is described a vehicle seat safety belt buckle with a locking element formed of a metal plate with a pair of laterally extending tabs at one end thereof by means of which the plate is tiltably carried in openings in the sides of a U-shaped frame to permit movement of a projection into or out of an aperture in a tongue to be locked into the frame. A retaining member for the locking element is guided in L-shaped slots in the sides of the frame and is associated with an articulated rocker actuable by a tongue ejector. Moreover a slidable release button is provided with surfaces which cooperate in an unlocking sense with the locking element and can also assist in lifting the locking projection out of the tongue aperture. In this arrangement the retaining element is movable into its locking position by a rocking member which is pivotally actuated by a tongue ejector when the tongue is inserted and this rocking member at the same time changes the line of action of a compression spring to urge the locking element towards its locking position.

The buckle described above has some shortcomings in that it is not inertially immune to impulses such as may be caused by the action of a seat-belt pretensioner in crash conditions. Also locking of the element is dependent upon the aforementioned change of line of action of the compression spring, and the balance of the set of conditions to achieve this may be critical.

The present invention has the object of reducing the above shortcomings.

According to the present invention, there is provided a seat belt buckle comprising a generally U-shaped frame, presenting an opening at one end for receiving a tongue between two side portions and generally parallel to a base portion, said tongue being engageable with a spring loaded ejector, a locking element having means at one end engaging the side portions to be tiltable therebetween whereby a projection of said element is movable into or out of locking relationship with an aperture of said tongue and a retaining member movable into or out of a locking position wherein it prevents movement of the projection away from said locking relationship and said retaining member being movable by the action of a release member to permit release of the tongue characterised in that a spring loaded rocking member is pivotally located by said tiltable locking element so that the spring loading of said rocking member acts in a sense to urge the rocking member into a position to constrain the retaining member to said locking position thereof and the release member has means operable to move the rocking member against said spring loading and permit displacement of the retaining member from its locking position.

In accordance with a particular feature of the invention, the rocking member is inertially substantially balanced about its pivot point or preferably is inertially over-balanced in a sense to prevent any tendency to move out of its restraining position in relation to the restraining member under frontal crash conditions.

In order that the invention may be more clearly understood and readily carried into effect, the same will now be further described by way of an example with reference to the accompanying drawings.

DETAILED DESCRIPTION OF THE DRAWINGS

Figure 1:
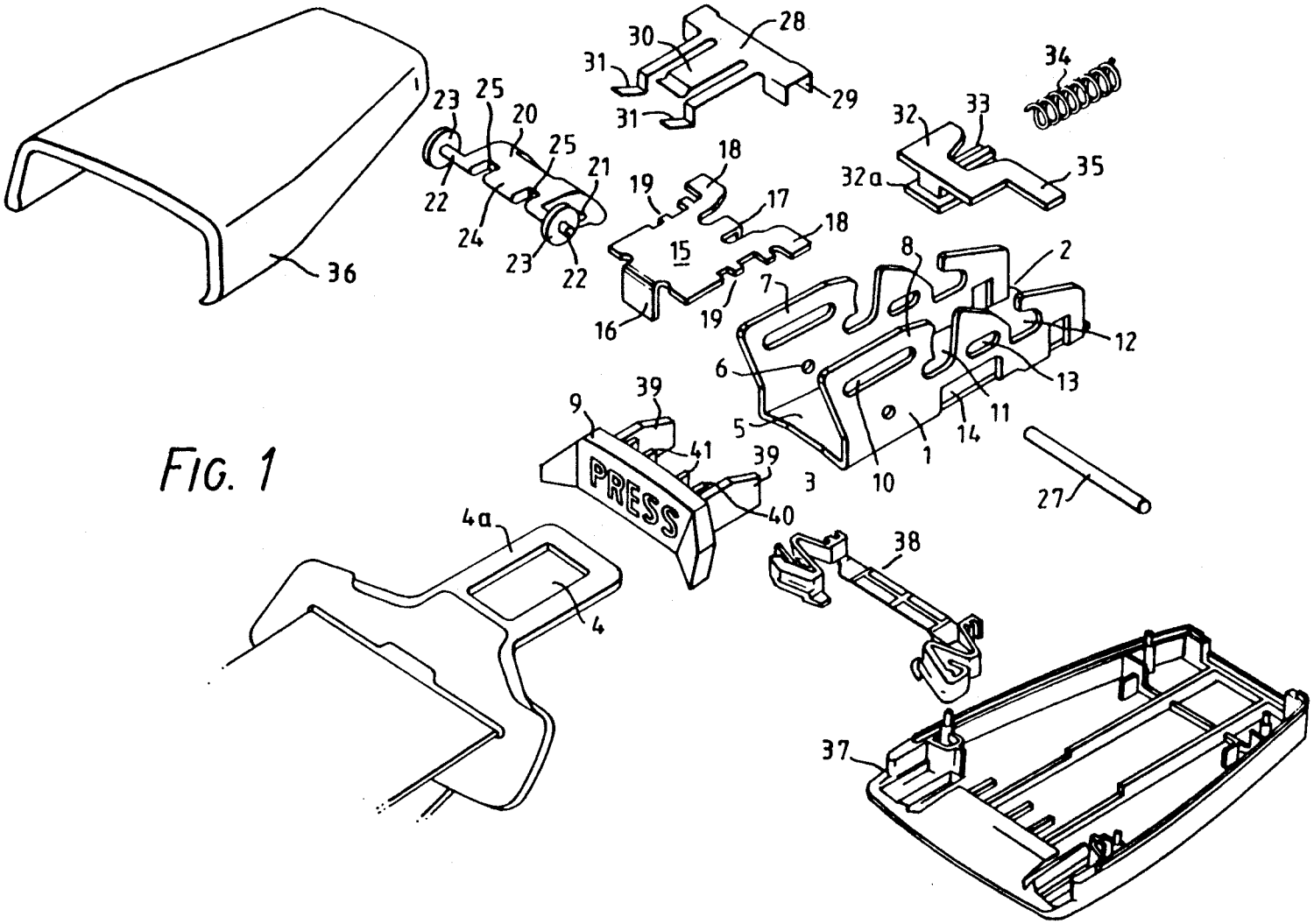
FIG. 1 illustrates the component parts of a buckle and a tongue.
Figure 2:
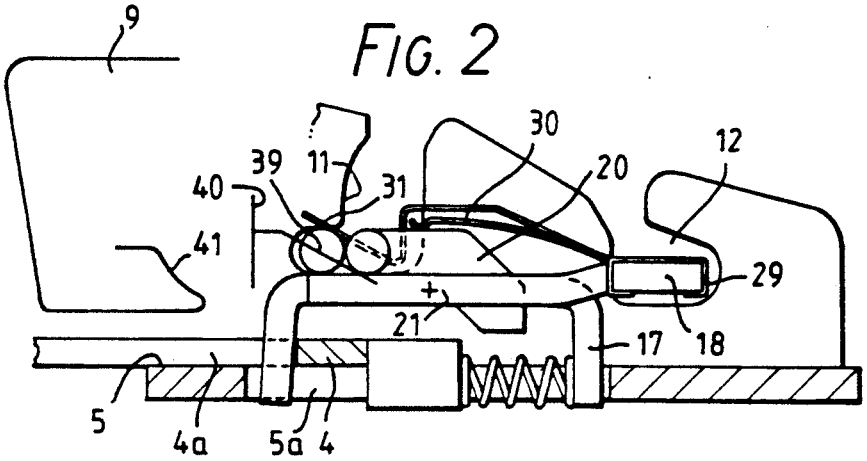
FIG. 2 illustrates diagrammatically the assembled buckle with the tongue inserted.

Referring now to FIGS. 1 and 2 of the drawings, the buckle comprises a generally U-shaped pressed steel frame 1, the right hand end 2 of which is provided with means (not shown) whereby it is anchored to the main structure of a vehicle. The left hand end 3 presents an aperture which receives the tongue 4 of a seat belt between the lower central frame portion 5 and inward guide pips 6 formed into the respective side portions 7 and 8. The left hand end of the frame also receives a plastic moulded release member comprising a button 9 to be referred to below.

The side portions 7 and 8 are each provided with longitudinal slots 10, L-shaped cut-outs 11 and 12, shorter longitudinal slots 13 and further apertures 14 and 14*a* adjacent the portion 5. A locking element, for the inserted tongue 4, comprises a lock plate 15 having downward projections 16 and 17, the former of which resides through a tongue aperture 4*a* and aperture 5*a* of the frame part in the locked position thereof. The plate 15 has lateral projections 18 at the right hand end which are locatable in the cut-outs 12 whereby the plate 15 pivots between the frame side portions 7 and 8. The plate 15 has further lateral projections 19 which form pivots for a spring loaded rocking member 20, the pivoting point of which is indicated at 21. This rocking member is designed in its locking position to be so substantially inertially balanced about its pivoting point 21, as to be immune to sharp changes of speed in the direction of action of tongue 4. The rocking member 20 has lateral projections 22 which will be seen to cooperate with the release button and which carry disc shaped members 23 spaced inwardly from the ends of projections 22. Members 23 themselves spaced apart serve to laterally locate a lock plate retaining pin 27 within the L-shaped cut-outs 11.

The spring loading of the rocking member 20 relative to the plate 15 is provided by a unitary spring element 28 the right hand end of which is shaped with inverted U-shaped portions 29 which during assembly are crimped around the projections 18 of plate 15. Spring loading of the rocker is thus provided by a central leaf 30 which bears against a portion 24 of the rocker while rather longer spring leaves 31 are shaped to be freely accommodated by notches 25 of the rocker while nevertheless being in constant engagement with the pin 27 and acting thereon in a sense to urge the pin into a leftmost locking position in the L-shaped cut-outs 11.

The buckle assembly is further provided with a tongue ejector indicated by reference 32 guided by a part 32*a* slidable in a slot (not shown) in the portion 5 and carrying a spigot 33 which locates one end of an ejector spring 34 and the travel of the ejector within the frame is limited by the action of a lateral projection 35 in a slot 14 of the frame. The other end of the ejector spring 34 under compression in the assembled buckle is located by the aforementioned projection 17 of the plate 15 so that its action is in a sense to urge plate 15 with its projection 16 towards the locking position thereof in relation to the tongue aperture 4*a*.

Although forming no part of the present invention, the assembled buckle is provided with upper and lower moulded plastic covers 36 and 37 which together with the release button 9 serve to enclose the complete assembly.

If required, a further resilient plastic moulded insert 38 may be inserted in the lower cover and, which by virture of its shape and resilience acts, within the belt aperture, on the lateral edges of the belt tongue 4, to inhibit any tendency for audible rattle.

Referring now to the longitudinally slidable release button 9. This button is guidingly located by means of inward projections (not shown) which locate in the elongated slots 10 of the side frames 7 and 8. The release button is provided with three pairs of ramps or abutments. Firstly, outer ramps 39 which move on the outside of the frame sides 7 and 8, are engageable with the lateral projections 22 of the rocker member 20 in a sense which lifts them upwards in cut-outs 11 preparatory to movement of pin 27 away from its leftmost plate retaining position. Secondly, this latter movement (of pin 27) is effectable by abutments 40 of the button which move between the side frames 7 and 8. Thirdly, further ramps 41 which are carried between the abutments 40 are engageable in a lifting manner with the edges of plate 15 at either side of projection 16.

In operation (FIG. 2), the tongue 4 is locked into the assembly by virture of the projection 16 of the plate 15 passing through the aperture 4*a*. Movement parallel to portion 5 by tongue force on plate 15 is prevented by the projections 18 being located in cut-outs 12 of the frame. Moreover, tilting motion of the plate 15 away from the tongue 4 is positively preventable by the retaining pin 27 being urged into its locking position in L-shaped recesses 11. Again, inadvertent right movement of pin 27 out of this locking position, against the action of spring leaves 31, is preventable by portions 23 and 24 of rocker 20 resting in its path for such movement. Rocker 20 being spring urged by leaf 30 into such position, and also being immune as referred to above, to sudden impulses, has virtually no tendency to permit release unless acted upon by the release button.

Figure 3:
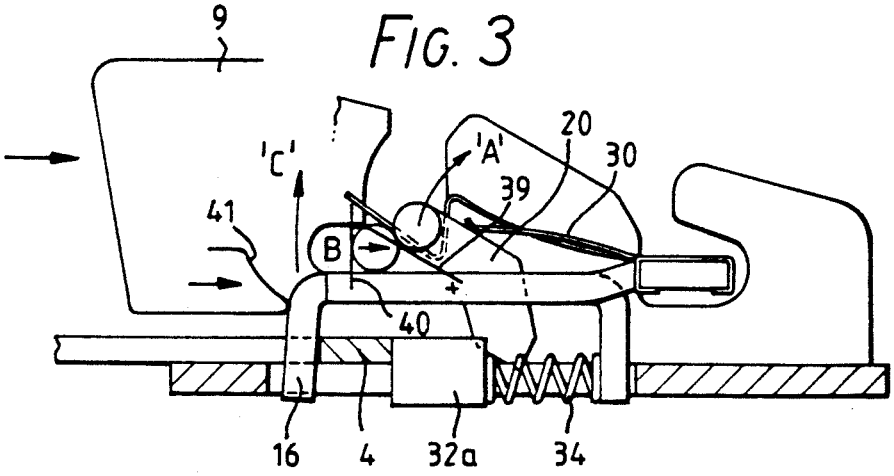
FIGS. 3–7 illustrate diagrammatically different stages of operation of the buckle.
Figure 4:
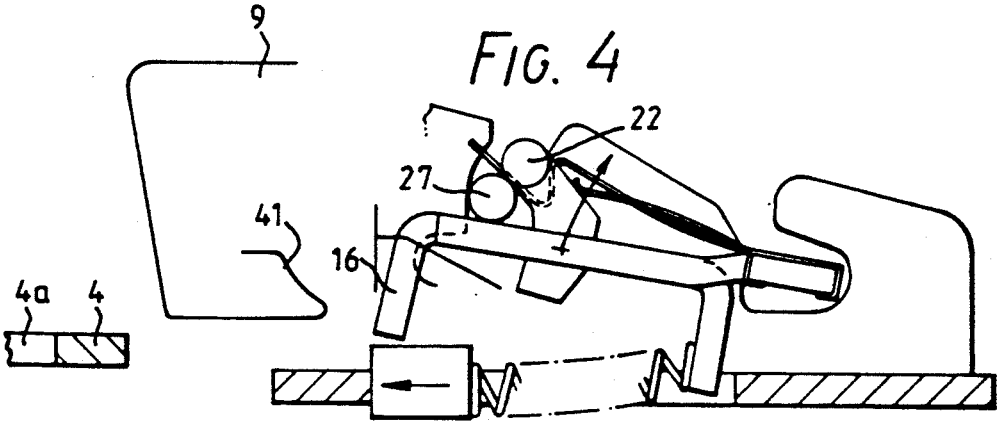

Referring now to FIG. 3, in order to release the tongue 4 from the buckle, the button 9 is pressed rightwardly by a vehicle seat occupant. The initial 3 or 4 millimeters of such movement causes the ramp 39 to engage projections 22 and thereby lift rocker 20 in sense of arrow "A" out of the path of pin 27, against the action of spring leaf 30. Further button movement results in abutment 40 driving pin 27 in sense of arrow "B" rightwards out of the locking portion of the L-shaped cut-out 11 against the action of spring leaves 31. Since the resultant combined tilting action of leaves 30 and 31 on the plate 15 is in the sense of an angular movement in the direction of arrow "C", and retaining member 27 is no longer effective, the plate 15 is tilted (see arrow "D") clockwise carrying projection 16 into a torque release position as shown in FIG. 4. The tongue is therefore released and then ejected by ejector 32 under the influence of spring 34. In the event of plate 15 not tilting spontaneously, it is engaged, as referred to above, by the ramps 41 which act in a sense to assist the releasing action and ensure proper release.

Figure 5:
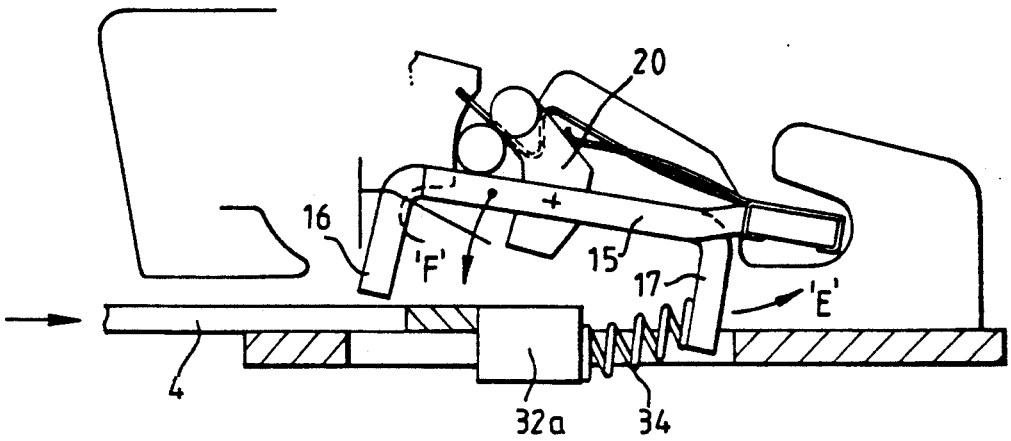
Figure 6:
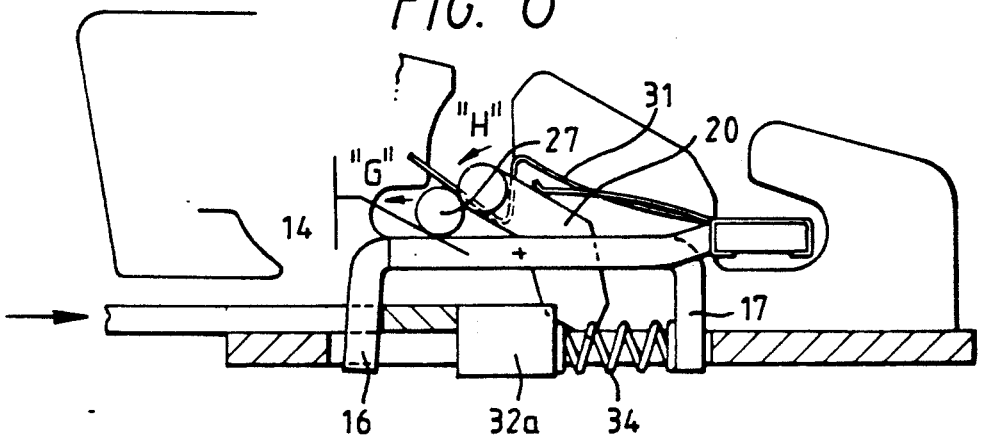
Figure 7:
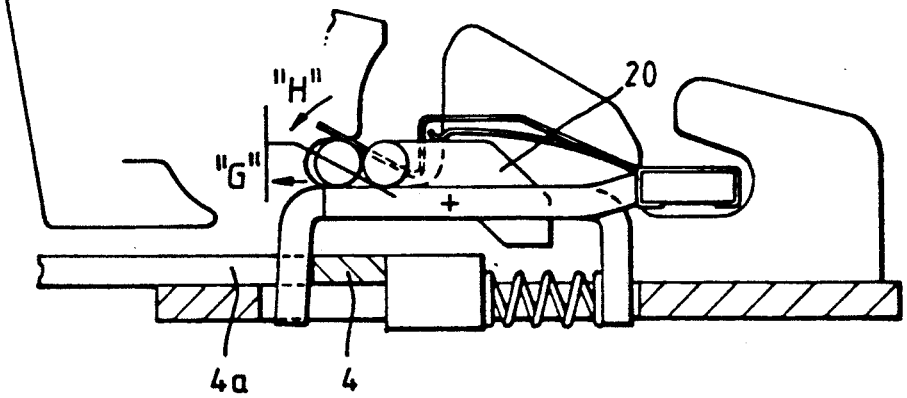

When the tongue 4 is reinserted as shown in FIG. 5, the manual force exerted thereon depresses the ejector rightwardly against the force of spring 34 compressing the spring to such extent that its force acts to tilt the plate 15 in the sense of arrows "E" and "F". The projection 16 therefore enters the aperture 4*a* of the tongue as shown in FIG. 6 and the restraining pin 27 is carried into alignment with the locking position of cut-out 11 which it enters, along the line of arrow "G" under the force of spring leaves 31. As rocker 20 is continuously spring loaded in direction of arrow "H" in FIG. 6, relative to plate 15, it is moved into the position against plate 15 formerly occupied by member 27 and the member 27 is relocked into the position as shown in FIG. 7.

While, in the seat belt buckle described in the foregoing, the rocker member 20 of FIG. 1 is designed by being balanced to be substantially inertially immune to excessive impulses taking place in the attached belt system, the invention offers the possibility for such impulses to at least not adversely affect the security despite the use of an unbalanced rocker member.

Figures 8, 8A:
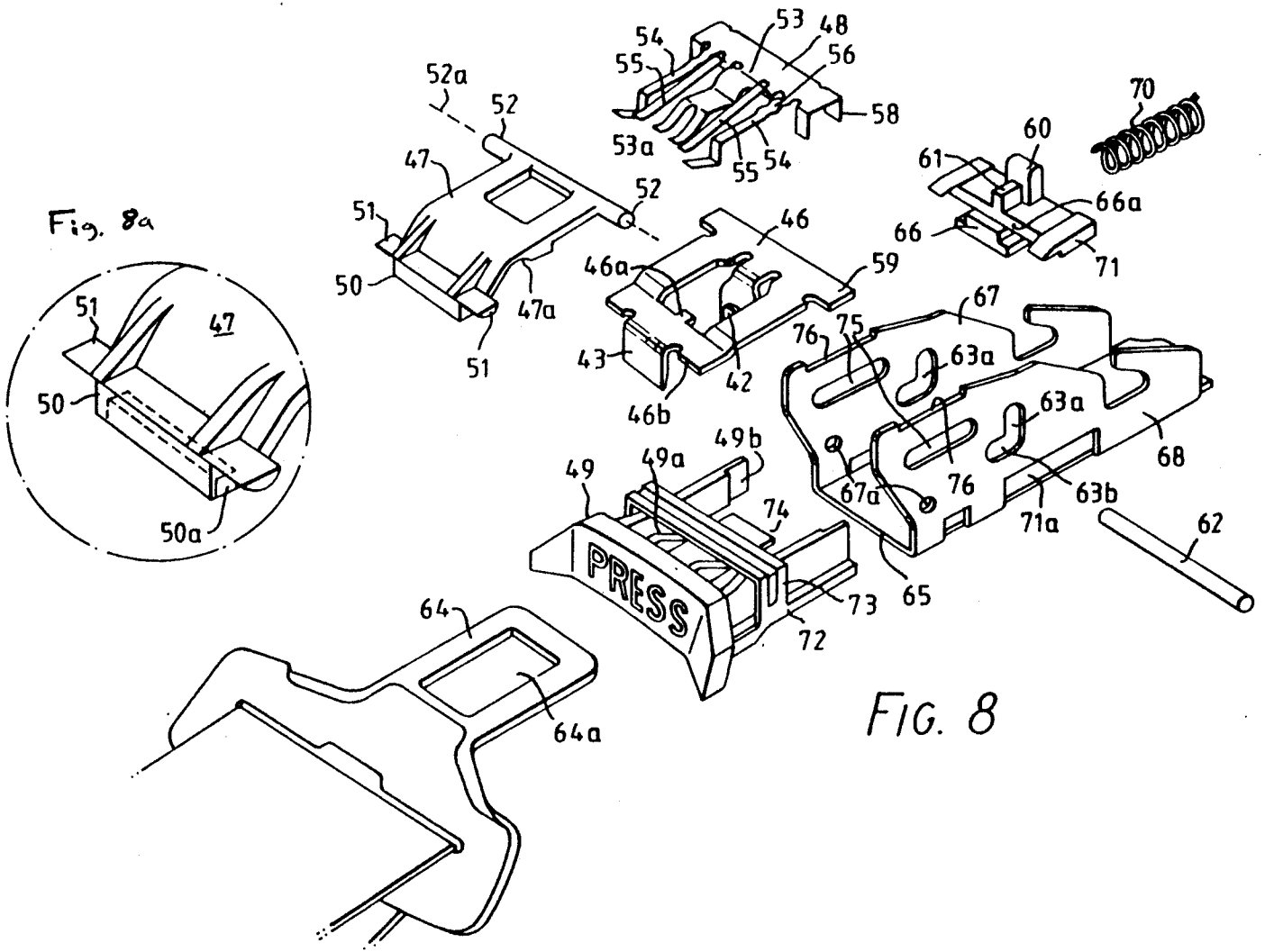
FIGS. 8 and 8*a* illustrate alternative embodiments of the buckle details.

Referring to FIG. 8, this embodiment of a buckle, the parts of which are shown therein, notably has modifications to the lock plate 46, rocker 47, the spring element 48, and the tongue ejector 66. The rocker 47 is now provided with a nose portion 50 designed to render it immune to pretensioner shocks and having lateral projections 51 for engagement by ramps of the release button. The rocker is now pivotally mounted on the lock plate 46 by the spring element 48 which now carries two pairs of integral spring leaves 54 and 55 symmetrically spaced either side of center leaf 53. Leaf 53 and leaves 54 are respectively formed with mutually facing indentations to provide pivotal bushing for the lateral projections 52 of rocker 47. The tongue ejector denoted by reference 66 has lateral wings 71 slidable within slots 71*a* of the frame sides 67 and has an upstanding heel 60 and finger 61 interacting with the lock plate and leaf spring 53 during the locking operating sequence. The release button has side rails 72 now joined by an integrally moulded bridge 73. These rails slide along the exterior of the frame sides 67 and present abutments 49(*b*) with the retaining pin 62. The release button also has a portion 74 movable within the side frames and presenting cam surfaces 49(*a*) engageable with the ends 50,51 of the rocker 47 and thereafter with the facing edges 46(*b*) of the lock plate 46. Not shown in FIG. 8 are inward projections on the side rails 72 which snap into and are slidingly movable within the elongated button guide slots 75 of the frame sides 67 and 68. Together with the bridge piece 73, these projections serve to position and guide the operation of the button 49, the bridge piece 73 being accommodated in recesses 76 of the outer edges of the frame sides.

The buckle is assembled by first inserting the ejector and then mounting thereto together with spring 70, the sub-assembly of lock plate, unitary leaf springs element 48, and rocker 47. Insertion of the overlocking or retaining pin 62 via the L-shaped slots 63(*a*) then serves to constrain the lock bar sub-assembly in the frame 65 prior to the mounting thereto of the release button which is snapped into place with the mentioned inward projections located in slots 75 and bridge piece 73 located in recesses 76. Pips 67*a* project inwardly of the side frames to guide the insertion of the belt tongue 64 and ensure that the tongue does not impede action of the button.

Figure 9:
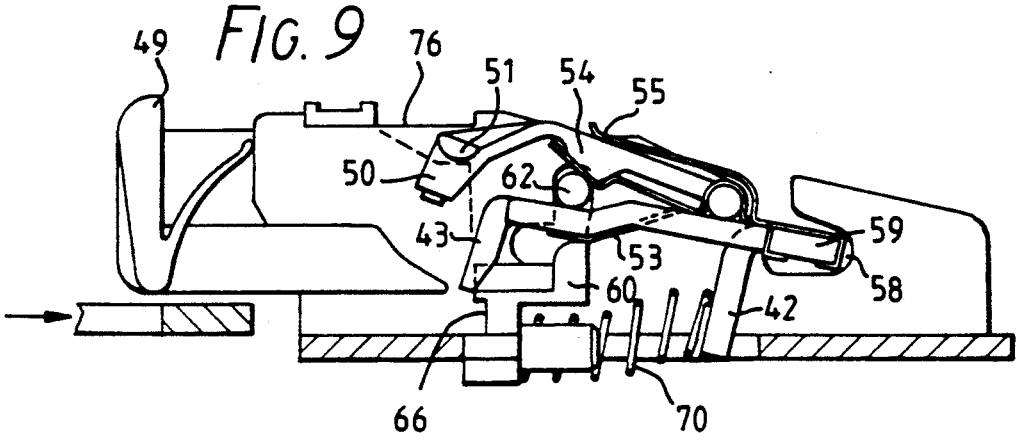
FIGS. 9–13 illustrate successive stages of the operation thereof.

The operation of the assembled buckle is again best to be understood by reference to FIGS. 9 to 13. FIG. 9 shows the buckle in a released condition ready to receive the tongue. The locking plate 46 having the spring element 48 retained by tabs 58 wrapped around lateral projection 59, is held in the unlocked condition shown by the action of spring leaf 53 resting upon the heel 60 of the tongue ejector 66 in its fully extended position with the ejector spring 70 in its most expanded state. The spring leaves 55 rest against the rocker 47 in a sense pivotally urging the rocker towards the lock plate and the spring leaves 54 rest against the lock plate retaining pin 62, which at this time is in its non-locking position within L-shaped cut-outs 63 of the side portions 67 and 68.

Figure 10:
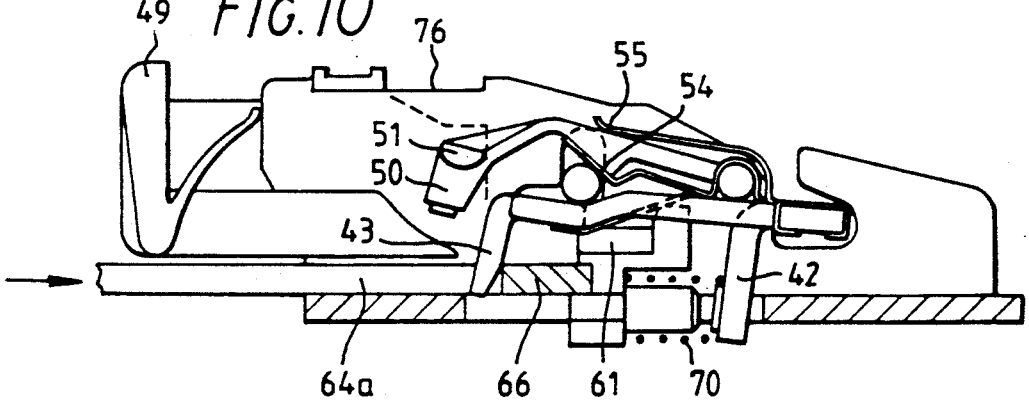
Figure 11:
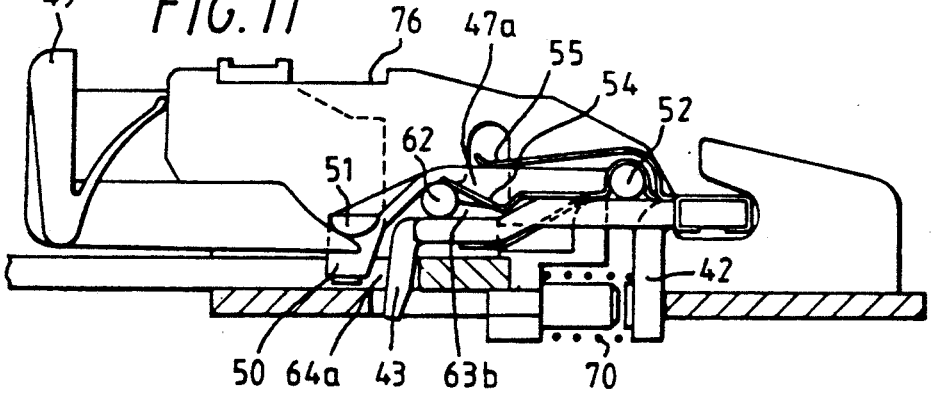

FIG. 10 illustrates the initial action of the buckle mechanism upon insertion of the tongue. The tongue engages face 66*a* of the ejector 66 compressing ejector spring 70 against the downward projection 42 of the lock plate 46, thereby urging the lock plate with its projection 43 towards the tongue aperture 64*a*. The lock plate carries with it the pin 62 which is therefore moved towards the port 63*a* of the L-shaped cut-out, which is parallel to the direction of entry of the tongue. The projection 46*a* of lock plate 46 now engages the outward surface of the finger 61 of the ejector 66 such that forked end 53*a* of spring leaf 53 is unable to urge the lock plate into full locking position within the aperture 64*a* of the tongue. As shown in FIG. 11, however, as soon as the projection 43 of the locking plate is aligned for free entry into the aperture 64*a*, the finger 61 moves from beneath the projection 42 to permit timed entry of the projection 43 into the tongue aperture 64*a* of the tongue. The forked ends of 53 move to either side of finger 61 effecting the desirable stability transition and at this time the pin 62 is also now aligned with the portions 63*a* of the L-shaped apertures and moves under the influence of spring leaves 54 into its lock plate retaining position, the pin 62 itself being retained by the action of the step 47*a*.

The position of instability of locking element 46 acted upon opposingly by the ejector spring 70 on the one hand and the leaf spring 53 on the other hand is determinable by the fact that the spring 53 rests as aforesaid against the heel 60 of the ejector 66. During locking of an inserting tongue, the heel 60 moves in relation to the forked end of 53 in a sense to reduce the unlocking force moment on the locking element to a point wherein the action of spring 70 takes over fairly precisely at the desired point of timed entry of the projection into the locking relationship with tongue 64.

Figure 12:
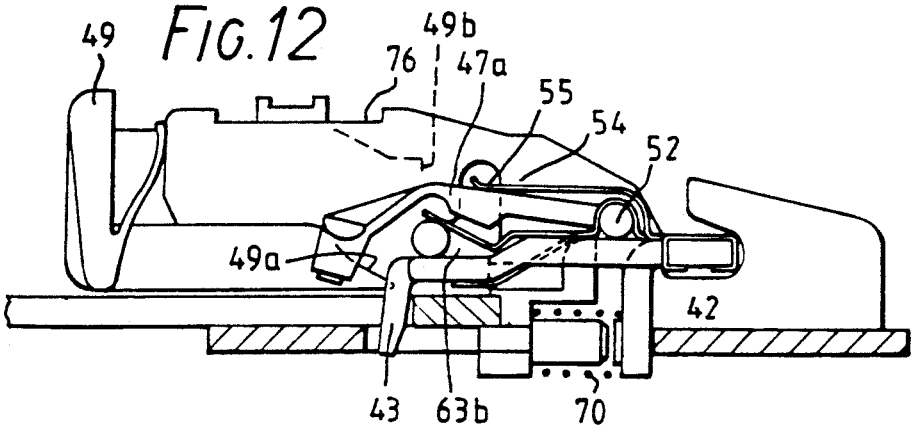
Figure 13:
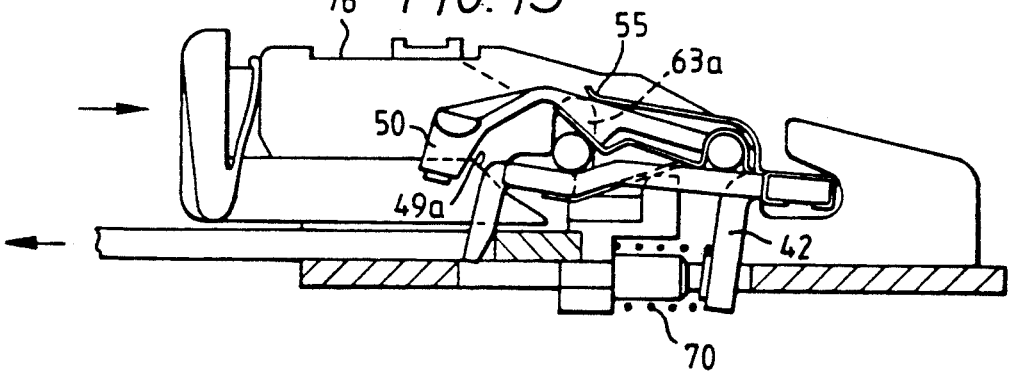

Considering now the release action of the buckle, when the button 49 is depressed as shown in FIG. 12, the lateral projections 51 of the rocker 47 are engaged by ramps 49(*a*), whereby the rocker is lifted out of engagement with the pin 62 and pin 62 is then abutted by faces 49(*b*) of the button urging it, against the action of spring leaves 54 towards the limbs 63(*b*) of the L-shaped cut-outs. Thus as shown in FIG. 13, the locking plate 46 is able to move pivotally about 52 assisted by possible engagement with ramps 49(*a*) of the button and carrying pin 62 with it, releasing tongue 64 and ejecting it by virtue of the force of spring 70. Following such release the buckle then rests in the state shown in FIG. 9.

By virture of the configuration of the rocker 47, it has an outward end 50 which, in the locking condition of the buckle as shown in FIG. 11, is over center in relation to the pivot axis at 52*a* from the point of view of the direction of belt tension. There is a tendency for the inertia of rocker 47, retaining member 62, and release member 49 to cause the buckle to remain securely in its locking position in the event of a frontal crash. This is also true when a pretensioner in the buckle anchorage tail is triggered, but at the end of the pretensioner action rapid buckle deceleration may be such as to tend to cause both release member 49 and retaining member 62 to move towards a buckle releasing condition. The fact of the rocker 47 having a mass at its end 50 which is over center, nevertheless causes the rocker to remain in its position to resist such undesired movement of member 62. Also the provision of the magnet 50*a* shown inset in FIG. 8*a* provides additional security when in contact with the steel frame part 65 in the locked condition of the lock plate.

Many changes and modifications in the above described embodiment of the invention can, of course, be carried out without departing from the scope thereof. Accordingly, that scope is intended to be limited only by the scope of the appended claims.

I claim:

1. A seat belt buckle comprising a generally U-shaped frame, presenting an opening at one end for receiving a tongue between two side portions and generally parallel to a base portion, said tongue being engageable with a spring loaded ejector, a locking element having means engaging the side portions to be tiltable therebetween whereby a projection of said element is movable into or out of a locking relationship with an aperture of said tongue, and a retaining member movable into or out of a locking position wherein the retaining member prevents movement of the projection away from said locking relationship and said retaining member being movable by the action of a release member to permit movement of its locking element and release of the tongue wherein a spring loaded rocking member is pivotally carried on and movable about a fixed axis said tiltable locking element such that a spring loading of said rocking member acts in a sense to urge the rocking member into said position of engagement to constrain said retaining member to said locking position thereof and the release member having first means for moving the rocking member against said spring loading and second means operable to effect displacement of the retaining member from its locking position.

2. A seat belt buckle as claimed in claim 1, wherein said release member carries the second means for displacing said locking element away from said locking relationship.

3. A seat belt buckle as claimed in claim 1 wherein said locking element is spring biased towards said locking relationship by a spring under compression between said locking element and said tongue ejector.

4. A seat belt buckle as claimed in claim 1 wherein said rocking member has mass which is substantially inertially balanced about its pivot point such that it does not tend to move away from its position of locking engagement with the retaining member in the event of a crash impulse.

5. A seat belt buckle as claimed in claim 1 wherein said rocking member has inertial mass which is so located in relation to its pivoting point, that it tends to move into locking engagement with the retaining member in the event of pretensioning action on an anchorage of the buckle.

6. A seat belt buckle as claimed in claim 1 wherein said rocking member is pivotally located on lateral projections of said locking element.

7. A seat belt buckle as claimed in claim 1 wherein said rocking member has mass distribution in relation to its pivotal support on the locking element that its inertia tends to cause it to pivot into said position of engagement with said retaining member in the event of pretensioning action at a buckle anchorage.

8. A seat belt buckle comprising a generally U-shaped frame, presenting an opening at one end for receiving a tongue between two side portions and generally parallel to a base portion, said tongue being engageable with a spring loaded ejector, a locking element having means at one end engaging the side portions to be tiltable therebetween whereby a projection of said element is movable into or out of a locking relationship with an aperture of said tongue, and a retaining member movable into or out of a locking position wherein the retaining member prevents movement of the projection away from said locking relationship and said retaining member being movable by the action of a release member to permit release of the tongue wherein a spring loaded rocking member is pivotally located by said tiltable locking element such that a spring loading of said rocking member acts in a sense to urge the rocking member into a position to constrain said retaining member to said locking position thereof and the release member has first means for moving the rocking member against said spring loading and permitting displacement of the retaining member from its locking position wherein a unitary spring element carried by the locking element has leaf spring elements which act respectively on the rocking member and the locking element in a direction urging them respectively towards and away from the respective locking position and locking relationship.

9. A seat belt buckle as claimed in claim 8 wherein one said leaf spring element acts between said retaining member and said locking element.

10. A seat belt buckle as claimed in claim 8 wherein said rocking member is pivotally located on said tiltable locking element by said unitary spring element.

11. A seat belt buckle comprising a generally U-shaped frame, presenting an opening at one end for receiving a tongue between two side portions and generally parallel to a base portion, said tongue being engageable with a spring loaded ejector, a locking element having means engaging the side portions to be tiltable therebetween whereby a projection of said element is movable into or out of a locking relationship with an aperture of said tongue, and a retaining member movable into or out of a locking position wherein the retaining member prevents movement of the projection away from said locking relationship and said retaining member being movable by the action of a release member to permit release of the tongue wherein a spring loaded rocking member is pivotally carried on said tiltable locking element such that a spring loading of said rocking member acts in a sense to urge the rocking member into a position to constrain said retaining member to said locking position thereof and the release member has first means for moving the rocking member against said spring loading and permitting displacement of the retaining member from its locking position wherein said base portion is ferromagnetic and said rocking member includes a magnetic part which engages said base portion when the locking element is in said locking relationship.

12. A seat belt buckle comprising a generally U-shaped frame, presenting an opening at one end for receiving a tongue between two side portions and generally parallel to a base portion, said tongue being engageable with a spring loaded ejector, a locking element having means engaging the side portions to be tiltable therebetween whereby a projection of said element is movable into or out of a locking relationship with an aperture of said tongue, and a retaining member movable into or out of a locking position wherein the retaining member prevents movement of the projection away from said locking relationship and said retaining member being movable by the action of a release member to permit release of the tongue wherein a spring loaded rocking member is pivotally carried on said tiltable locking element such that a spring loading of said rocking member acts in a sense to urge the rocking member into a position to constrain said retaining member to said locking position thereof and the release member having first means for moving the rocking member against said spring loading and permitting displacement of the retaining member from its locking position wherein the locking element has a leaf spring secured thereto, a leaf of which acts therebetween and the rocking member.

13. A seat belt buckle as claimed in claim 12 wherein said leaf spring has a further leaf acting on said retaining member in a sense to urge it towards said locking position in relation to the locking element.

14. A seat belt buckle as claimed in claim 12 wherein said rocking element is pivotally carried on said locking element by a shaped portion of said leaf spring.

15. A seat belt buckle comprising a generally U-shaped frame, presenting an opening at one end for receiving a tongue between two side portions and generally parallel to a base portion, said tongue being engageable with a spring loaded ejector, a locking element having means engaging the side portions to be tiltable therebetween whereby a projection of said element is movable into or out of a locking relationship with an aperture of said tongue, and a retaining member movable into or out of a locking position wherein the retaining member prevents movement of the projection away from said locking relationship and said retaining member being movable by the action of a release member to permit release of the tongue wherein a spring loaded rocking member is pivotally carried on said tiltable locking element such that a spring loading of said rocking member acts in a sense to urge the rocking member into a position to constrain said retaining member to said locking position thereof and the release member has first means for moving the rocking member against said spring loading and permitting displacement of the retaining member from its locking position including a buckling tongue ejector with an ejector spring acting between said locking element and said tongue ejector in a sense to urge said locking element towards said locking relationship with the tongue and said locking element carrying a leaf spring slidingly and resiliently and engageable with apart of said tongue ejector and so shaped that it acts in a sense to oppose the action of said ejector spring up to a predetermined position of the ejector at which instability of the locking element occurs during insertion of the buckling tongue.

16. A seat belt buckle as claimed in claim 15 wherein said locking element includes a part which is engageable with said tongue ejector to prevent movement of said locking element into said locking relationship up to a predetermined position of the ejector on insertion of the tongue.

17. A seat belt buckle comprising a generally U-shaped frame, presenting an opening at one end for receiving a tongue between two side portions and generally parallel to a base portion, said tongue being engageable with a spring loaded ejector, a locking element having means engaging the side portions to be tiltable therebetween whereby a projection of said element is movable into or out of a locking relationship with an aperture of said tongue, and a retaining member movable into or out of a locking position wherein the retaining member prevents movement of the projection away from said locking relationship and said retaining member being movable by the action of a release member to permit release of the tongue wherein a spring loaded rocking member is pivotally located by said tiltable locking element such that a spring loading of said rocking member acts in a sense to urge the rocking member into said position to constrain said retaining member to said locking position thereof and the release member has first means for moving the rocking member against said spring loading and permitting displacement of the retaining member from its locking position wherein said rocking member includes a magnetic part engageable with a further ferromagnetic part of the buckle to assist in maintaining the rocking member in said position of engagement with said retaining member.

* * * * *